US009988898B2

(12) United States Patent
McColphin

(10) Patent No.: US 9,988,898 B2
(45) Date of Patent: Jun. 5, 2018

(54) METHOD AND SYSTEM FOR MONITORING AND MANAGING FIBER CABLE SLACK IN A COILED TUBING

(71) Applicant: Halliburton Energy Services, Inc., Houston, TX (US)

(72) Inventor: Glenn Robert McColphin, Katy, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 926 days.

(21) Appl. No.: 13/942,054

(22) Filed: Jul. 15, 2013

(65) Prior Publication Data

US 2015/0013975 A1 Jan. 15, 2015

(51) Int. Cl.
*E21B 47/12* (2012.01)
*E21B 47/09* (2012.01)

(52) U.S. Cl.
CPC ..... *E21B 47/123* (2013.01); *E21B 47/09* (2013.01)

(58) Field of Classification Search
None
See application file for complete search history.

(56) References Cited

U.S. PATENT DOCUMENTS 6,281,489 B1 * 8/2001 Tubel ..... E21B 47/00 166/250.15
6,532,839 B1 * 3/2003 Kluth ..... E21B 17/003 166/385
7,315,666 B2 * 1/2008 Van Der Spek ..... E21B 47/01 385/12
7,610,960 B2 * 11/2009 Mendez ..... E21B 47/04 166/250.01
2008/0204703 A1 * 8/2008 Hernandezs-Solis ... E21B 47/04 356/6
2005/0263281 A1 12/2008 Lovell et al.
2012/0085531 A1 4/2012 Leising et al.
2012/0273269 A1 11/2012 Rinzler et al.
2013/0094798 A1 4/2013 Duncan et al.

FOREIGN PATENT DOCUMENTS

WO 2012178143 A1 12/2012

OTHER PUBLICATIONS

International Search Report and Written Opinion issued in related PCT Application No. PCT/US/2014/044263, dated Oct. 27, 2014 (12 pages).
International Preliminary Report on Patentability issued in related PCT Application No. PCT/US/2014/044263 dated Jan. 28, 2016 (8 pages).

* cited by examiner

*Primary Examiner* — Uyen Chau N Le
*Assistant Examiner* — Chad H Smith
(74) *Attorney, Agent, or Firm* — John Wustenberg; Baker Botts L.L.P.

(57) ABSTRACT

A method and system for monitoring a cable within a coiled tubing is disclosed. A first set of excitation signals is applied to the coiled tubing at a first point in time. The first set of excitation signals comprises one or more signals applied at one or more depths. The cable is positioned at a first location within the coiled tubing at the first point in time. A signal corresponding to the first set of excitation signals is detected at one or more fiber optic lines associated with the cable and location of the cable within the coiled tubing is determined using the detected signal corresponding to the first excitation signal.

17 Claims, 2 Drawing Sheets

METHOD AND SYSTEM FOR MONITORING AND MANAGING FIBER CABLE SLACK IN A COILED TUBING

BACKGROUND

The present invention relates to subterranean operations and, more particularly, to a method and system for monitoring a coiled tubing.

Hydrocarbons, such as oil and gas, are commonly obtained from subterranean formations that may be located onshore or offshore. The development of subterranean operations and the processes involved in removing hydrocarbons from a subterranean formation are complex. Typically, subterranean operations involve a number of different steps such as, for example, drilling a wellbore at a desired well site, treating the wellbore to optimize production of hydrocarbons, and performing the necessary steps to produce and process the hydrocarbons from the subterranean formation.

When performing subterranean operations, it is often desirable to be aware of the characteristics of the formation being developed as well as various parameters reflecting the status of the particular operation being performed downhole. For instance, it may be desirable to know temperature, pressure, flow rate, resistivity, and other formation parameters.

In order to facilitate transfer of power, data and materials associated with the performance of subterranean operations, coiled tubing may be inserted into the wellbore. Coiled tubing is typically a metal piping whose diameter may vary depending on the particular application. In order to facilitate transmission of data signals, control signals, power signals, etc., cables of varying diameters may be directed downhole through the coiled tubing. Typically, the cables may be anchored into the coiled tubing with a system that permits them to tear away from the anchor if the cable tension approaches the yield strength of the cable.

In addition to cables, coiled tubing may be used to direct fluids associated with performance of subterranean operations into or out of the wellbore. Fluid flow through the coiled tubing may impact the positioning of the cables therein. Once the cables have moved out of their intended position, an operator may reposition them, for instance through reverse circulation. The term reverse circulation as used herein refers to either directing a suitable fluid downhole through the annulus between the coiled tubing and the wellbore (or the casing if the wellbore is cased) and back up through the coiled tubing or circulating fluid from the bottom to the top of the coiled tubing once it has been retrieved and stored on the reel assembly at the surface. The upward flow of fluids through the coiled tubing may then reposition the cables located therein through the application of frictional drag.

Accordingly, over time, a user may come up with conservative numbers for how many runs and at what flow rate, the system can be utilized before the cable "overstuff" needs to be repositioned through reverse circulation. The term "overstuff" as used herein refers to the length of cable inside the coiled tubing that exceeds the total length of the coiled tubing string. However, changes in fluid chemistry, flow rate, pumping time, depth and hole geometry can all affect how quickly the overstuff is moved to the bottom of the coil. It is therefore desirable to develop a method and system to monitor the position of cables within a coiled tubing in real-time without having to take the coiled tubing unit out of service.

SUMMARY

The present invention relates to subterranean operations and, more particularly, to a method and system for monitoring a coiled tubing.

In certain implementations, the present disclosure is directed to a method for detecting location of a cable having a fiber optic line within a coiled tubing comprising: applying a first signal to the coiled tubing; detecting a first received signal at one or more locations along the coiled tubing in response to the first signal, wherein the first received signal is detected by the fiber optic line; applying a second signal to the coiled tubing; detecting a second received signal at one or more locations along the coiled tubing in response to the second signal, wherein the one or more second received signals are detected by the fiber optic line; and using the one or more first received signals and the one or more second received signals to determine a change in location of the cable in the coiled tubing.

In certain embodiments, the present disclosure is directed to a method for detecting location of a cable in a coiled tubing comprising: applying a first set of excitation signals to the coiled tubing at a first point in time, wherein the first set of excitation signals comprises one or more signals applied at one or more depths, wherein the cable is positioned at a first location within the coiled tubing at the first point in time; and detecting a signal corresponding to the first set of excitation signals at one or more fiber optic lines associated with the cable and determining location of the cable within the coiled tubing using the detected signal corresponding to the first excitation signal.

In certain embodiments, the present disclosure is directed to a system for performing subterranean operations in a wellbore comprising: a coiled tubing, wherein the coiled tubing is placed on a reel, wherein the coiled tubing is extendable into the wellbore from the reel; a cable comprising one or more fiber optic lines located within the coiled tubing; a generator coupled to the coiled tubing, wherein the generator is operable to generate an excitation signal, wherein the one of more fiber optic lines detect a signal corresponding to the excitation signal generated by the generator, and wherein the detected signal corresponding to the excitation signal is used to determine positioning of the cable in the coiled tubing.

In certain embodiments, the present disclosure is directed to a method for locating a terminal end of a cable having a fiber optic line within a coiled tubing used to perform subterranean operations comprising: directing the coiled tubing into a wellbore; performing a subterranean operation using the coiled tubing; spooling the coiled tubing onto a reel; applying a first signal to the coiled tubing as the coiled tubing is spooled on the reel; receiving a second signal at one or more points along the fiber optic line in response to the first signal; and identifying a terminal end of the cable by monitoring the second signal.

The features and advantages of the present invention will be apparent to those skilled in the art from the description of the preferred embodiments which follows when taken in conjunction with the accompanying drawings. While numerous changes may be made by those skilled in the art, such changes are within the spirit of the invention.

BRIEF DESCRIPTION OF THE DRAWINGS

These drawings illustrate certain aspects of some of the embodiments of the present invention, and should not be used to limit or define the invention.

While embodiments of this disclosure have been depicted and described and are defined by reference to example embodiments, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

Illustrative embodiments of the present invention are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time-consuming, but would nevertheless be a routine undertaking for those of ordinary skill in the art having the benefit of the present disclosure.

The terms "couple" or "couples," as used herein are intended to mean either an indirect or a direct connection. Thus, if a first device couples to a second device, that connection may be through a direct connection, or through an indirect connection via other media, devices and/or connections. An indirect connection might result from thermal or acoustic energy moving through gas or fluid surrounding the coiled tubing, through the tubing material itself and finally through whatever gas or fluid is between the inside coil wall and the fiber optic cable located inside the coil. The term "upstream" as used herein means along a flow path towards the source of the flow, and the term "downstream" as used herein means along a flow path away from the source of the flow. The term "uphole" as used herein means along the drillstring or the hole from the distal end towards the surface, and "downhole" as used herein means along the drillstring or the hole from the surface towards the distal end.

It will be understood that the term "oil well drilling equipment" or "oil well drilling system" is not intended to limit the use of the equipment and processes described with those terms to drilling an oil well. The terms also encompass drilling natural gas wells or hydrocarbon wells in general. Further, such wells can be used for production, monitoring, or injection in relation to the recovery of hydrocarbons or other materials from the subsurface. This could also include geothermal wells intended to provide a source of heat energy instead of hydrocarbons.

The present invention relates to subterranean operations and, more particularly, to a method and system for monitoring a cable within a coiled tubing.

Figure 1:
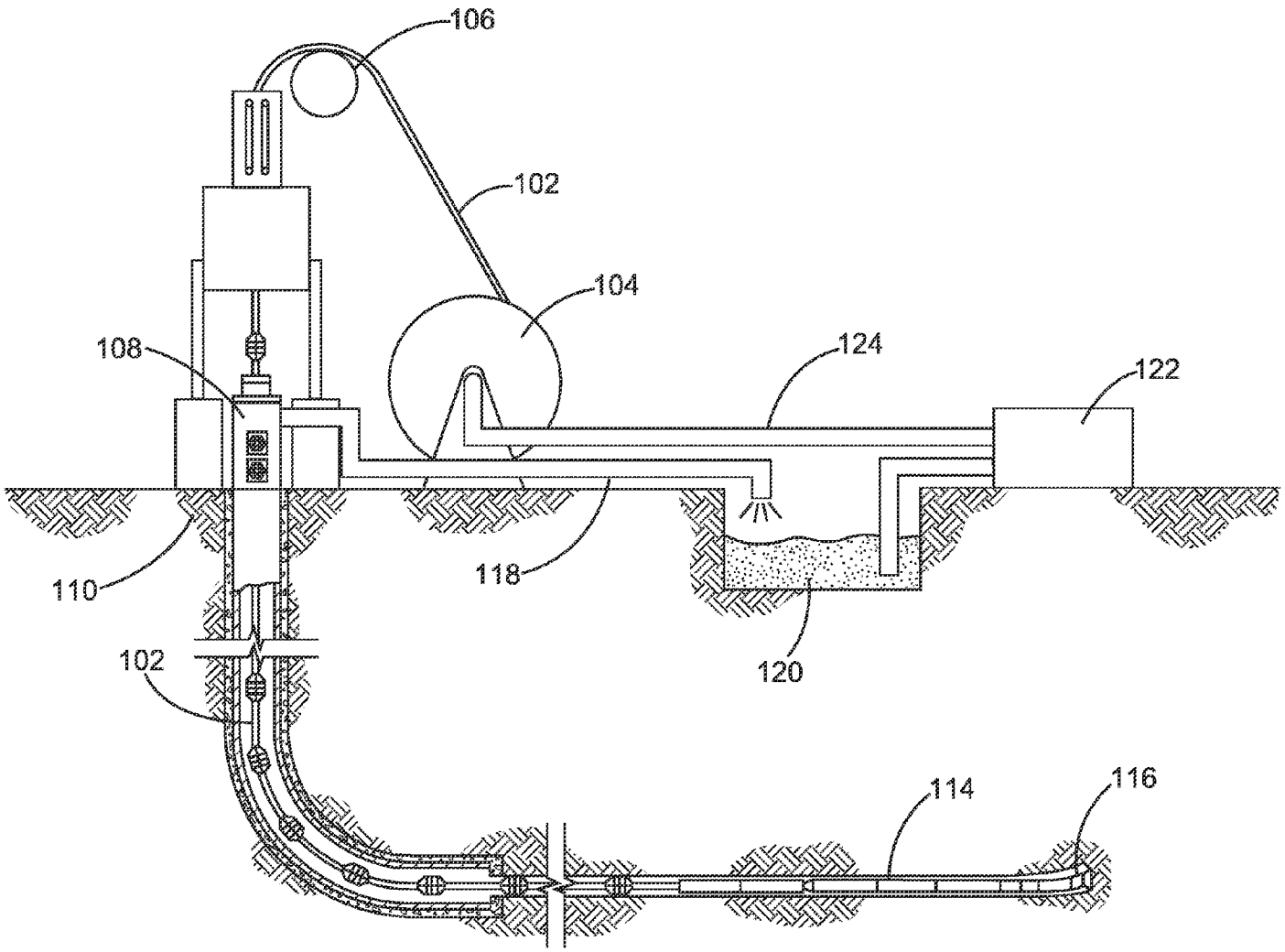
FIG. 1 depicts an illustrative system for performing subterranean operations using a coiled tubing.

Turning now to FIG. 1, an illustrative embodiment of a typical coiled tubing oil well drilling system is shown in FIG. 1. Although the illustrative embodiment of FIG. 1 shows a coiled tubing 102 as used during drilling operations, the present disclosure is not limited to that particular application and FIG. 1 is simply used to illustrate the different system components. The drilling system comprises the coiled tubing 102 which is placed on a reel 104. The coiled tubing 102 passes over a gooseneck 106 and is directed downhole through an injector head 108 into the formation 110. During a coiled tubing drilling operation, the coiled tubing 102 is fed off the reel 104 over an injector head 108 into the wellbore. Drilling fluid may be delivered to the bottom hole assembly 114 and the drill bit 116 through the coiled tubing 102. The drilling fluid may then be returned to the surface through the annulus between the wellbore wall (or casing if the wellbore is cased) and the coiled tubing 102. The returned fluid, which may contain drill cuttings and other materials, may be directed to a returned fluid pipe 118 and delivered to a mud pit 120. A recirculation pump 122 may then recirculate the drilling fluid through the pipe 124 to the coiled tubing 102.

Figure 2:
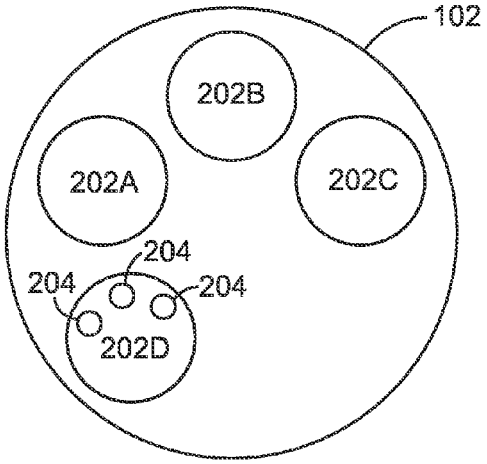
FIG. 2 depicts a cross-sectional view of a coiled tubing containing a plurality of cables, one of which includes one or more fiber optic lines.

FIG. 2 depicts a cross-sectional view of a coiled tubing 102 containing cables 202A, 202B, 202C, 202D where one of the cables 202D includes one or more fiber optic lines 204 therein. Although the following discussion focuses on operation of one of the fiber optic lines 204 in one of the cables 202D, the remaining fiber optic lines 204 and cables 202A-C may be utilized in the same manner.

The fiber optic line 204 may be a slickline or a wireline with fiber embedded therein. The term "slickline" as used herein refers to a single strand wire which is used to run tools into a wellbore to perform various subterranean operations. The term "wireline" as used herein refers to a wire that may be used to transmit power or signals uphole or downhole. Accordingly, the fiber optic lines 204 may have a dual use. The fiber optic lines 204 may be turned into distributed sensors or be connected to point sensors to be used for data telemetry. Moreover, the fiber optic lines 204 may have Fiber Brag Grating (FBG) multi-point sensors burned into them with a laser to provide additional readings. The fiber optic lines 204 may include one or more fibers, each acting as a distributed sensor that is sensitive to one or more properties such as, for example, temperature, strain or acoustics.

Figure 3A:
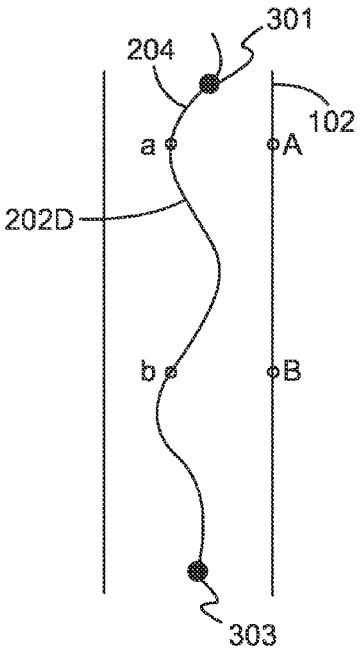
FIG. 3A depicts a side view of the coiled tubing of FIG. 2 having a cable in a relaxed state.

FIG. 3A depicts a side view of the coiled tubing 102 of FIG. 2, depicting the cable 202D that contains the fiber optic line 204 that runs through the coil. FIG. 3A depicts the initial arrangement of the cable 202D within the coiled tubing 102 before the coiled tubing 102 is utilized downhole with the cable 202D and its fiber optic line 204 in the relaxed state. As shown in FIG. 3A, the cable 202D and its fiber optic line 204 may initially be sinusoidally or helically (not shown) disposed within the coiled tubing 102. In certain embodiments, the cable 202D may be anchored inside the coiled tubing 102 at a first location proximate the top portion of the coiled tubing 102 string and at a second location proximate to the bottom portion of the coiled tubing string 102 by anchors 301 and 303, respectively. The length of the cable 202D and its fiber optic line 204 may exceed the length of the coiled tubing 102 string by an amount of overstuff to allow for tension and/or thermal elongation of the coiled tubing 102 without causing separation of the cable 202D from the coiled tubing 102. As shown in FIG. 3A, the distance along the cable 202D from a to b is longer than the distance along the coiled tubing 102 from A to B. This length differential is an illustration of the "overstuff" concept.

The fiber optic line 204 may sense acoustic or thermal energy that is applied to the coiled tubing 102 as well as any gas or fluid that may separate the fiber optic line from the inside wall of the coiled tubing. In one illustrative embodiment, the fiber optic line 204 may be arranged to sense the energy from the coiled tubing 102 in any desirable interval such as, for example, 1 meter intervals. As would be appreciated by those of ordinary skill in the art, having the benefit of the present disclosure, the resolution is a function of the laser interrogator mechanics and software that turn the glass fiber into a distributed sensor. The ability of the fiber optic line 204 to sense acoustic or thermal energy that is applied to the coiled tubing 102 allows identification of the location of the fiber optic line 204 within the coiled tubing 102 in its initial relaxed state as well as throughout utilization of the coiled tubing 102.

When performing a sensing operation, an excitation signal may be applied to the coiled tubing 102. The transmission of this excitation signal may then be detected downhole using the fiber optic line 204. In certain implementations, the excitation signal may be an acoustic signal or a thermal signal that is applied to the coiled tubing 102. Any suitable mechanisms may be used to apply an acoustic signal or a thermal signal to the coiled tubing 102. The fiber optic line 204 may then be used to monitor the transmission of that signal downhole.

In certain implementations a thermal signal may be applied to the coiled tubing 102. Specifically, a thermal tracer method may be used where the coiled tubing 102 is heated at multiple locations with a heater (e.g., an electric heater such as heat tape or a simple blow dryer or heat gun). The fiber optic line 204 may then be used to monitor heat transmission through the coiled tubing 102 to the fiber optic line itself. Alternatively, a cooling device such as, for example, ice could also be applied to one or more locations on the coiled tubing 102 as an example of a negative thermal event which can be monitored along the coiled tubing 102 using the fiber optic line 204. A Distributed Temperature Sensor ("DTS") may then be used to monitor temperature changes. In certain embodiments, the DTS systems used may be operable to identify temperature changes as small as 0.01 degrees Celsius.

In certain implementations, a thermal slug may be directed downhole through the coiled tubing 102. The thermal slug may comprise of any suitable materials which can be environmentally pumped into the ground which create either an exothermic or endothermic reaction. In certain implementations, the thermal slug may be pumped downhole. The rate at which the thermal slug is pumped downhole may be known. Alternatively, one can measure the amount of thermal slug that is directed downhole over time. Additionally, the inner diameter (ID) of the coiled tubing 102 is known. Accordingly, the location of the thermal slug within the coiled tubing 102 can be determined over time. In certain implementations, a DTS may be used to monitor the location of the thermal slug within the coiled tubing 102. A linear overstuff of the fiber optic line 204 within the coiled tubing 102 would result in a linear movement of the thermal slug front. The term "linear overstuff" as used herein refers to a uniform amount of overstuff per unit length of coiled tubing. Further, changes in the position of the overstuff inside the coiled tubing between runs would be highlighted if a thermal slug were placed at the same positions within the coiled tubing. For instance, a mismatch of location depths of the thermal slug from a first point in time to a second point in time would be indicative of non-uniform overstuff. The term "non-uniform overstuff" as used herein refers to a varying amount of overstuff per unit length of coiled tubing.

In certain implementations, the acoustic system utilized may be sensitive enough to detect acoustic energy from a sound generator (e.g., human voice) transmitted through the coiled tubing and to the fiber optic line 204 residing inside. Moreover, an acoustic signal may be applied by tapping on the coiled tubing (e.g., by hand or by a hammer) or tuning forks may be used to apply acoustic signals in instances where there is background noise and it is desirable to apply an acoustic signal of a predetermined frequency. In accordance with the present disclosure, the system may be monitored for amplitude events or for frequency events depending on the particular application and downhole conditions.

As would be appreciated by those of ordinary skill in the art, having the benefit of the present disclosure, acoustic energy may travel primarily through the coiled tubing 102 because the metallic walls of the coiled tubing 102 act as a good acoustic conductor. However, some of the acoustic energy may couple to the fiber optic line 204 as it travels downhole. The speed at which acoustic energy travels through the coiled tubing 102 may be known and will not vary from one run to another. The location of acoustic energy in the fiber optic line 204 may then be determined and compared with the location of the acoustic energy traveling through the coiled tubing 102 wall. This comparison may then be used to determine if and/or how the location of the fiber optic line 204 within the coiled tubing 102 changes from one run to another. Further, in certain embodiments, a fluid having an acoustic marker may be directed downhole through the coiled tubing. The term acoustic marker as used herein refers to sand, proppant, air or nitrogen bubbles or any other suitable material that will generate an acoustic signature. In certain implementations the acoustic markers may be activated using a suitable mechanism such as by deploying a thermal slug.

In certain implementations, a fluid (e.g., a thermal slug when using thermal excitation or a fluid containing an acoustic marker when using acoustic excitation) may be pumped downhole from the surface through the coiled tubing 102 at a first point in time. A first set of measurements of acoustic amplitude or frequency at a distance from the end of the coil may then be obtained. At a second point in time, the same fluid may be directed up through the terminal end of the coiled tubing 102 located downhole and to the surface using the same pump rate as that used in the first instance. A second set of measurements may then be obtained. Any difference between the first set of measurements and the second set of measurements may then be attributed to the difference in overstuff. With the coil having a uniform inner diameter ("ID"), it is known how far a slug of fluid will travel for a given volume pumped. Stated otherwise, the location of the top and the bottom of the slug is known. Therefore, because the volume of the slug pumped is known, at any given time T, the location of the slug is known. Additionally, the location of the slug in relation to the total length of the fiber optic line is known. In certain implementations, a first slug (slug #1) may be pumped downhole and a first relationship between the fiber length and the coil length is identified. Next, a second slug (slug #2) may be pumped downhole and used to identify a second relationship between the fiber length and the coil length which is indicative of the distribution of the overstuff. For example, as one illustration, if a slug is pumped 100 ft downhole and its movement is identified over 200 ft of fiber, it may be concluded that there is a large amount of overstuff. In contrast, if the slug is pumped downhole 100 ft and its movement is identified over 105 ft of fiber, then it may be concluded that the fiber line is almost in tension with minimal overstuff.

Figure 3B:
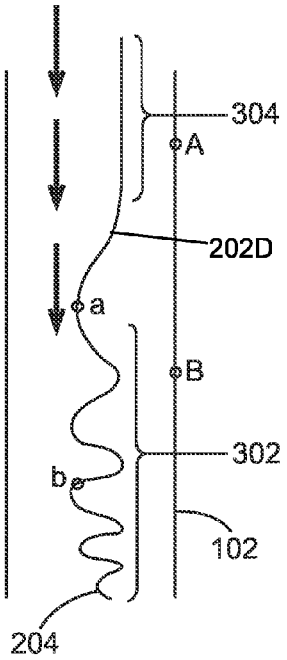
FIG. 3B depicts a side view of the coiled tubing of FIG. 2 having a cable in a tension state at an upper portion and a compressed state at a lower portion thereof.

For instance, in certain illustrative embodiments the coiled tubing 102 may simply be hit with a hammer when it is at a specific position on the reel 104. The fiber optic line 204 inside the coiled tubing 102 can then be used to detect the impact. The coiled tubing 102 can then be moved to multiple additional specified positions and impacted again. In FIGS. 3A and 3B, points "A" and "B" on the coiled tubing 102 represent these fixed points. The properties (e.g., amplitude or frequency) of the signal received on the fiber optic line 204 may then be used to determine the relative location of the fiber optic line 204 within the coiled tubing 102 system with a predetermined accuracy. For instance, in an embodiment where the optical fiber line 204 is arranged to sense the energy from the coiled tubing 102 in 1 meter intervals, the depth of the impact may be identified within a 1 meter accuracy. The end result is a lookup table showing distance along the coiled tubing 102 against the distance along the fiber optic line 204.

Once the coiled tubing 102 is installed downhole, fluids may flow through it. For instance, as discussed in conjunction with FIG. 1, the coiled tubing 102 may be utilized to perform drilling operations in which case drilling fluids may flow through the coiled tubing 102 (as shown by the arrows in FIG. 3B). FIG. 3B depicts the cable 202D and its fiber optic line 204 in their tension state. Specifically, as fluids flow through the coiled tubing 102, the cable 202D and its fiber optic line 204 may become bunched up at its downhole end 302 while its uphole end 304 comes under tension. This is shown by a comparison of FIGS. 3A and 3B. Specifically, as shown in FIG. 3A, the points denoted as "a" and "b" on the cable 202D are initially located at a position corresponding to the points "A" and "B" on the coiled tubing 102, respectively, with the cable 202D and its fiber optic line 204 in their relaxed stated. As shown in FIG. 3B, the points denoted as "a" and "b" are moved and the cable 202D and its fiber optic line 204 go in a tension state as fluid flows through the coiled tubing 102.

In accordance with certain implementations, a first excitation signal may be applied to the coiled tubing 102 at a first point in time and a second excitation signal may be applied at a second point in time. Each excitation signal generates a received signal at one or more points along the fiber optic line 204 that is inside the cable 202D. Accordingly, a change in the received signal at a given point along the fiber optic line 204 between the first point in time and the second point in time may be used to determine a change in location of the cable 202D within the coiled tubing 102 between the first point in time and the second point in time.

Finally, once the coiled tubing 102 is no longer needed downhole, the operator may retrieve the coiled tubing 102 back on to the reel 104. As the coiled tubing 102 is pulled up, the fluid flow through the coiled tubing 102 together with the gravitational force may cause the cable 202D and its fiber optic line 204 to be pulled to the bottom side of the coiled tubing 102 due to tension. As a result, the fiber optic line 204 slack is moved to the bottom of the coiled tubing 102 where gravity and fluid flow further pull the optical fiber line 204 downhole through the coiled tubing 102.

The thermal and/or acoustic testing may then be repeated to monitor the change in location of the optical fiber line 204 (and corresponding cable 202D) within the coiled tubing 102. Specifically, as the coiled tubing 102 is spooled back onto the reel 104 after performing a desired subterranean operation, an excitation signal (e.g., an acoustic signal or a thermal signal) may be applied to the coiled tubing 102 at the same reference point(s) where the first excitation signal (s) were applied prior to the coiled tubing 102 being used. Once again, the application of the excitation signal may entail hitting the coiled tubing 102 with a hammer at the same location that was struck before. The differences in where the noise is detected on the fiber optic line 204 inside the coiled tubing 102 between the initial state (relaxed state) and subsequent tension states (e.g., when the coiled tubing is being used, when the coiled tubing is being spooled back, etc.) may be used to show how the fiber optic line 204 and the corresponding cable 202D overstuff is being positioned inside the coiled tubing 102 from one run to another.

In instances when one or more fluids are pumped through the coiled tubing 102 at high rates, the cable 202D overstuff may move to the downstream end of the coiled tubing 102, potentially placing a portion of the cable 202D and its optical fiber line 204 in tension. By tracking the overstuff distribution of the cable 202D from one run to another, it can be determined when the overstuff has reached a level where it needs to be repositioned. In certain embodiments, once it is determined that a repositioning of the overstuff is required a hydraulic pumping operation may be performed to return the cable 202D (and its optical fiber line 204) to its relaxed state.

Although the present disclosure discusses acoustic testing, in certain embodiments thermal testing of the coiled tubing may be used in the same manner. Specifically, the optical fiber line 204 may also detect thermal changes in the coiled tubing 102. Accordingly, instead of applying an acoustic signal to the coiled tubing 102 at a relaxed state and subsequent tension states (as discussed above), a thermal signal may be applied and used to trace how the cable 202D is moving within the coiled tubing 102 over time. For instance, a heat gun (not shown) may be used to generate the thermal signal.

Moreover, in certain implementations, a set of signals may be applied and analyzed at one or more desired locations instead of applying a single signal. Specifically, a first set of signals may be applied to the coiled tubing 102 at a first point in time. The first set of signals may be comprised of one or more signals that are applied at the same time at one or more depths. In response, a first signal may be received by the fiber optic line 204 at one or more desired locations along the coiled tubing 102. Subsequently, a second set of signals may be applied to the coiled tubing 102 at a second point in time. The second set of signals may be comprised of one or more signals that are applied at one or more depths. In response, a second signal may be received by the fiber optic line 204. The first signal received by the fiber optic line 204 and the second signal received by the fiber optic line 204 may be used to determine the location of the cable 202D inside the coiled tubing 102 as disclosed herein.

A coiled tubing may be directed into a wellbore and may be used to perform one or more subterranean operations. The coiled tubing may then be spooled back onto a reel as it is removed from the wellbore. In order to remove the cable 202D from the coiled tubing 102, it may be desirable to be able to cut the coiled tubing 102 after fluids have been pumped there through in the exact location needed to retrieve the cable 202D and make a termination. Typically, coiled tubing 102 is cut at the surface. However, one can typically not visually inspect the inside of the coiled tubing 102 any further than a few feet, even with a light. Therefore, it is not practical to determine location of the end of a cable 202D located within the coiled tubing 102 with visual inspection. Typically, multiple, time consuming cuts of the coiled tubing 102 are made until the cable 202D is visible and then a final cut is made.

However, an approach in accordance with the methods and systems disclosed herein eliminates the need for multiple cuts, instead permitting an operator to accurately identify the location of the end of a cable 202D (also referred to as the "terminal end: of the cable 202D) within the coiled tubing 102. Specifically, an excitation signal (e.g., an acoustic signal or a thermal signal), or a set of excitation signals as discussed above, may be applied to the coiled tubing 102 when spooling the coiled tubing 102 back onto the reel. The transmitted energy may be detected at the last channel of the fiber optic line 204. The fiber optic line 204 inside the cable 202D is turned into a distributed sensing device with thousands of measurement points. For instance, a fiber optic line 204 that is 2000 meters long may be treated as a cable having 2000 sensing points located 1 meter apart. The last sensing point in the fiber optic line 204 is within 1 meter of the end of that line. By tapping on the coiled tubing 102 that surrounds the cable 202D, one can "hear" the sound on the fiber optic lines 204 within the cable 202. As the coiled tubing 102 is extended into the wellbore, one can continue to tap. As tapping continues and the coiled tubing 102 is extended into the wellbore, the amplitude of the signal increases on the end channel of the fiber optic line 204. The term "end channel" as used herein refers to the last detectable sensing point on the fiber optic line 204 before one can detect the reflection signaling the end of the fiber. This continues until the end channel is passed. Specifically, if the end channel is passed, the sound will decrease at that point and start to increase at other channels further down the line. Specifically, the terminal end of the cable 202D is reached when the signal detected by the last channel of the fiber optic line 204 inside the cable is at its maximum value.

Similarly, for the thermal method, one may travel down the coiled tubing 102 with a heat source (e.g., a hair dryer or a heat gun) as the coiled tubing 102 is spooled back onto a reel 104. One can then identify the point along the coiled tubing 102 where the end of the fiber cable 202D is directly under the heat source. Specifically, as the coiled tubing 102 is moved uphole onto the reel 104 a heat source may be provided to direct heat to the coiled tubing 102. At the same time, the thermal readings at the point of the optical fiber line 204 corresponding to the end of the cable 202D may be monitored. The thermal readings registered will continue to increase as the coiled tubing 102 is moved uphole until the end point of the cable 202D passes the thermal source at which point the thermal readings begin to decrease. Accordingly, the point of the coiled tubing 102 where the thermal reading reaches its maximum value corresponds to the end of the cable 202D.

Therefore, the method and system disclosed herein provides a non-invasive technique that facilitates monitoring position of a cable within a coiled tubing after each run or after two or more runs. Therefore, time and money may be conserved by not repositioning the overstuff too early. Additionally, cable breaks are eliminated by identifying premature cable tension issues after each run without having to take the coiled tubing out of service.

Therefore, the present invention is well-adapted to carry out the objects and attain the ends and advantages mentioned as well as those which are inherent therein. While the invention has been depicted and described by reference to exemplary embodiments of the invention, such a reference does not imply a limitation on the invention, and no such limitation is to be inferred. The invention is capable of considerable modification, alteration, and equivalents in form and function, as will occur to those ordinarily skilled in the pertinent arts and having the benefit of this disclosure. The depicted and described embodiments of the invention are exemplary only, and are not exhaustive of the scope of the invention. Consequently, the invention is intended to be limited only by the spirit and scope of the appended claims, giving full cognizance to equivalents in all respects. The terms in the claims have their plain, ordinary meaning unless otherwise explicitly and clearly defined by the patentee.

What is claimed is:

1. A method for detecting a location of a cable within a tubing comprising:

providing a cable comprising a fiber optic line disposed within a tubing;

applying a first excitation signal to the tubing at a first point in time;

detecting a first received signal at one or more locations along the tubing in response to the first excitation signal, wherein the first received signal is detected by the fiber optic line;

applying a second excitation signal to the tubing at a second point in time;

detecting a second received signal at one or more locations along the tubing in response to the second excitation signal, wherein the second received signal is detected by the fiber optic line; and determining a change in location of the cable within the tubing between the first point in time and the second point in time using the first received signal and the second received signal, wherein at least one of the first excitation signal and the second excitation signal comprises at least one of an acoustic signal and a thermal signal generated by a slug directed downhole through the tubing.

2. The method of claim 1, wherein the thermal signal is generated using a thermal slug directed downhole through the tubing.

3. The method of claim 1, wherein the acoustic signal is generated using at least one of a tapping device and a tuning fork.

4. The method of claim 1, wherein the acoustic signal is generated using a fluid having an acoustic marker directed downhole through the tubing.

5. A method for detecting a location of a cable within a tubing comprising:

applying a first set of excitation signals to a tubing at a first point in time, wherein the first set of excitation signals comprises one or more signals applied at one or more depths, wherein the first set of excitation signals comprises at least one of an acoustic signal and a thermal signal; and detecting a first detected signal corresponding to the first set of excitation signals at one or more fiber optic lines associated with a cable disposed within the tubing and determining a location of the cable within the tubing using the first detected signal;

applying a second set of excitation signals to the tubing after a fluid is directed through the tubing, wherein the second set of excitation signals comprises one or more signals applied at one or more depths at a second point in time, wherein the first set of excitation signals comprises at least one of an acoustic signal and a thermal signal; and detecting a second detected signal corresponding to the second set of excitation signals at the one or more fiber optic lines associated with the cable; and determining a change in location of the cable within the tubing using the first detected signal and the second detected signal.

6. The method of claim 5, wherein the one or more signals of the second set of excitation signals is selected from a group consisting of an acoustic signal and a thermal signal.

7. The method of claim 6, wherein the acoustic signal is generated by a fluid having an acoustic marker directed downhole through the tubing.

8. The method of claim 6, wherein the thermal signal is generated by a thermal slug directed downhole through the tubing.

9. The method of claim 5, further comprising:

directing the tubing into a wellbore;

performing one or more subterranean operations using the tubing;

retracting the tubing out of the wellbore;

applying a second set of excitation signals to the tubing as the tubing is retracted, wherein the second set of excitation signals comprise one or more signals applied at one or more depths at a second point in time;

detecting a signal corresponding to the second set of excitation signals at the one or more fiber optic lines associated with the cable and determining location of the cable within the tubing using the detected signal corresponding to the second set of excitation signals.

10. The method of claim 9, wherein the one or more signals of the second set of excitation signals is selected from a group consisting of an acoustic signal and a thermal signal.

11. The method of claim 10, wherein the acoustic signal is generated using at least one of a human voice, a hammer and a tuning fork.

12. The method of claim 10, wherein the thermal signal is generated using at least one of a blow dryer, a heat gun and a cooling device.

13. A system for performing subterranean operations comprising:

a tubing that is extendable into a well bore;

a cable comprising one or more fiber optic lines located within the tubing; and a generator structured and arranged to apply a first excitation signal at a first point in time and a second excitation signal at a second point in time to the tubing, wherein the one or more fiber optic lines comprise a detector at a location along the tubing that detects a first received signal and a second received signal in response to the first excitation signal and second excitation signal, respectively, wherein the first received signal and the second received signal comprise information to determine a change in location of the cable within the tubing between the first point in time and the second point in time, wherein at least one of the first excitation signal and the second excitation signal comprises at least one of an acoustic signal and a thermal signal generated by a slug directed downhole through the tubing, and wherein the first received signal and the second received signal comprise information regarding a location of the cable with respect to the tubing.

14. The system of claim 13, wherein the at least one of the first excitation signal and the second excitation signal is an acoustic signal and the generator is selected from a group consisting of a human voice, tuning fork, a hammer, and a slug comprising an acoustic marker.

15. The system of claim 13, wherein the at least one of the first excitation signal and the second excitation signal is a thermal signal and the generator is selected from a group consisting of a blow dryer, a thermal slug, and a heat gun.

16. A method for locating a terminal end of a cable, having a fiber optic line within a tubing used to perform subterranean operations comprising:

directing the tubing into a wellbore;

performing a subterranean operation within the wellbore using the tubing;

retracting the tubing out of the wellbore;

applying a first excitation signal and a second excitation signal to the fiber optic line as the tubing is retracted, wherein the first excitation signal and the second excitation signal are selected from a group consisting of an acoustic signal and a thermal signal generated by a slug directed downhole through the tubing;

detecting with the fiber optic line a first received signal corresponding to the first excitation signal at a first location along the tubing and a second received signal corresponding to the second excitation signal at a second location along the tubing, wherein the first received signal and the second received signal comprise information regarding a location of the cable with respect to the tubing; and determining a change in location of the terminal end of the cable with respect to the tubing between a first point in time and a second point in time based on the first received signal and the second received signal.

17. The method of claim 16, wherein determining the location of the terminal end of the cable with respect to the tubing based on the received signal comprises:

monitoring a last channel of the fiber optic line; and identifying the location of the terminal end of the cable when any one or more received signals detected at the last channel reaches a maximum value.

* * * * *